US006397505B1

(12) United States Patent
Stratton et al.

(10) Patent No.: US 6,397,505 B1
(45) Date of Patent: Jun. 4, 2002

(54) CARTRIDGE CASING EJECTOR FOR A FIREARM

(75) Inventors: Steven J. Stratton, Hurricane; Justin C. Sip, LaVerkin, both of UT (US)

(73) Assignee: Virgin Valley Custom Guns, LLC, Las Vegas, NV (US)

( * ) Notice: Subject to any disclaimer, the term of this patent is extended or adjusted under 35 U.S.C. 154(b) by 0 days.

(21) Appl. No.: 09/454,067

(22) Filed: Dec. 2, 1999

(51) Int. Cl.[7] ..... F41A 15/16

(52) U.S. Cl. ..... 42/47; 42/8; 42/25; 42/40; 42/46

(58) Field of Search ..... 42/8, 40, 46, 25, 42/47

(56) References Cited

U.S. PATENT DOCUMENTS

| | | | | |
|---|---|---|---|---|
| 763,458 A | * | 6/1904 | Beach | |
| 1,530,041 A | | 3/1925 | Fearn | |
| 3,193,960 A | | 7/1965 | Stevens | 42/46 |
| 3,346,983 A | | 10/1967 | Brooks | 42/47 |
| 3,710,494 A | | 1/1973 | Hyytinen | 42/47 |
| 3,715,825 A | | 2/1973 | Ilmonen | 42/47 |
| 3,967,402 A | * | 7/1976 | Cooksey | 42/10 |
| 3,984,933 A | | 10/1976 | Ruger | 42/47 |
| 4,121,364 A | * | 10/1978 | Kaltenegger | 42/32 |
| 4,516,345 A | | 5/1985 | Flodman | 42/46 |
| 4,646,458 A | | 3/1987 | Stevens | 42/8 |
| 4,914,845 A | * | 4/1990 | Reese et al. | |
| 4,964,232 A | * | 10/1990 | Mainland et al. | 42/44 |
| 4,976,059 A | * | 12/1990 | Marzocco | |

FOREIGN PATENT DOCUMENTS

| | | | |
|---|---|---|---|
| SU | 0017100982 | * | 2/1992 |

* cited by examiner

*Primary Examiner*—Michael J. Carone
*Assistant Examiner*—John Richardson
(74) *Attorney, Agent, or Firm*—Ron L. Phillips; Quirk & Tratos

(57) ABSTRACT

The cartridge ejector has a spring loaded ejector slide supported by the barrel pivot block for siding motion from a seated position to an eject position. The slide has a finger configured to engage the cartridge casing rim when the casing is seated at the breech end and the slide is at the seated position. Opposite the finger is a catch captured by a sear. In response to opening the breech the slide snaps to the eject position to eject and throw the cartridge casing from the breech.

4 Claims, 2 Drawing Sheets

CARTRIDGE CASING EJECTOR FOR A FIREARM

FIELD OF THE INVENTION

The present invention relates cartridge casing ejection mechanisms for breakable breech-type firearms such as single shot pistols, rifles and shotguns.

BACKGROUND OF THE INVENTION

In firearms, such as single shot firearms, shotguns and the like, a barrel assembly is provided which includes the barrel for the firearm. The barrel has a receiver end into which the cartridge is manually inserted for firing. After the cartridge has been inserted into the barrel receiver, the barrel assembly is pivotally closed to a breech assembly which includes the breech, firing pin and the like. When the barrel assembly is closed the barrel receiving end abuts the breech for firing. After the firearm is fired, the breech is opened to revel the spent cartridge casing. The casing, for many firearms, must be manually removed with the fingers which can result in burning of the fingers by the hot casing. Further, time is consumed in removing the casing. In shooting competition, the time necessary to remove the casing is time which is lost.

In some firearms there is a casing withdrawal mechanism which, as the barrel assembly is pivoted from the breech, pulls the casing from the barrel receiver to a withdrawn position where the shooter can grasp the casing to remove it from the firearm.

One such firearm is a Thompson® Contender® which includes the casing withdrawal mechanism. This mechanism includes a slide which has at one end a finger to engage the cartridge casing. In response to pivoting of the barrel assembly the slide is urged rearwardly which withdraws the casing from the barrel for grasping by the shooter. The speed of withdrawal of the cartridge is related to the speed at which the barrel is pivoted. In no case can the barrel be pivoted fast enough to impart sufficient momentum to the casing to forcefully eject the casing free from the barrel.

It would be advantageous to provide an ejector mechanism which is adapted to throw, in response to pivoting of the barrel assembly, the casing from the barrel to thus dispense with the need for the shooter to manually pull the casing from the barrel receiver. It would be advantageous to provide such an ejector mechanism which can be retrofit in firearms such as a such a Thompson® Contender®.

SUMMARY OF THE INVENTION

There is, therefore, set forth according to the present invention a cartridge ejector for a firearm of the type having a breech assembly and a barrel assembly including a barrel having a receiver end to receive a cartridge and abut the breech assembly when the breech is closed for firing of the firearm. The barrel assembly is adapted to pivot from the breech assembly to open the breech for loading and removing a cartridge casing from the barrel receiver end. Further the cartridge casing includes a rim. The ejector includes a pivot block disposed on the barrel assembly to support the barrel for pivoting motion to open and close the breech. A stock assembly is provided to support the barrel and pivot block for pivoting relative to the breech assembly for opening and closing the breech. Suitable breech locking means are provided for locking the breech closed for firing and unlocking the barrel for pivoting to open the breech. The cartridge Hector has an ejector slide supported by the pivot block for siding motion from a seated position to an eject position, the slide including a finger configured to engage the cartridge casing rim when the casing is seated at the breech end and the slide is at the seated position. Opposite the finger is a catch. A spring disposed between the slide and the pivot block urges the slide from the seated position to the eject position to extend outwardly from the receiver end and a sear is pivotally disposed at the pivot block and has an arm to engage the catch to hold the slide at the seated position against the bias of the spring. A release is moveably disposed in the pivot block to engage and pivot the sear in response to opening of the breech to disengage the arm from the catch to release the slide to snap to the eject position to eject and throw the cartridge casing from the breech.

In one version where the ejector is to be retrofit in a firearm having a withdrawal mechanism, the slide, retainer and release are arranged in an in-line configuration so as to be contained within the pivot block in the former position of the withdrawal mechanism.

BRIEF DESCRIPTION OF THE DRAWINGS

These and other features and advantages, will become better appreciated as the same becomes better understood with reference to the claims, specification and drawings wherein:

DESCRIPTION

Figure 1:
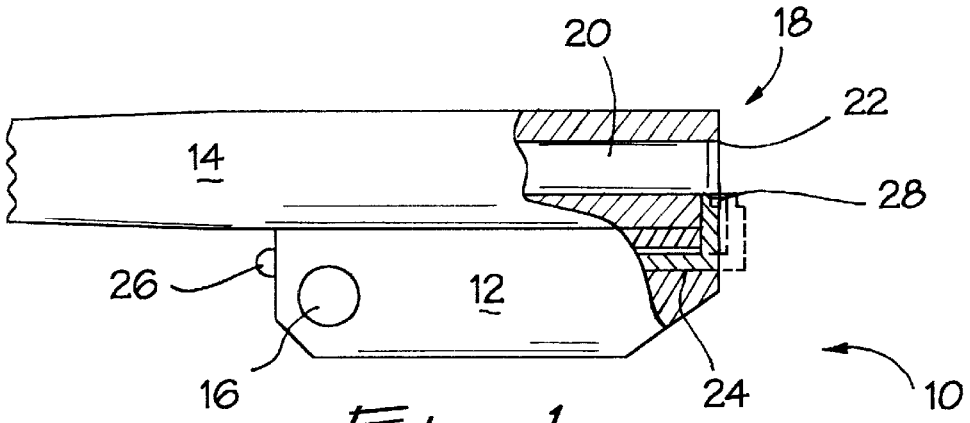
Fig. 1 PRIOR ART
FIG. 1 is an illustration of a prior art cartridge withdrawal mechanism.

Turning to the drawings, FIG. 1 illustrates a prior art ejector 10 of the type used in a Thompson® Contender® firearm. The ejector 10 is exposed in a pivot block 12 which is adapted to support a barrel 14 for rotation about a stock assembly (not shown in FIG. 1) in a manner known in the art. To accommodate the pivoting motion, a pivot bore 16 is provided laterally through the pivot block 12. The barrel 14 is cylindrical and includes a breech end 18 and chamber 20 which is adapted to receive a cartridge. The breech end 18 has a countersink 22 to accommodate the rim of a typical cartridge.

The pivot block 12 is substantially rectangular in lateral section and includes therethrough a channel 24 which is adapted to receive for sliding motion the ejector 10. The ejector 10 passes through the channel 24 to an end 26.

As is known, when the pivot block 12 and barrel 14 are pivoted to close the breech of the firearm, the closure thereof draws the ejector 10 into a seated position where at it is received into a slot 28 fashioned in the barrel 14 breech end 18 to receive the cartridge rim flush into the countersink 22 and the cartridge into the chamber 20. After firing, the breech is opened by pivoting the barrel 14 and pivot block 12 which, by a cam surface (not shown) urges the ejector 10 outwardly from the breech end 18 to withdraw the cartridge casing from the chamber 20. In this position, the shooter grasps the cartridge rim and fully withdraws it from the chamber 20. A new cartridge is inserted into the chamber 20 such that its rim engages the ejector 10 and as the breech is closed by pivoting about the bore 16, the ejector 10 is returned to a seated position whereat it nests into the slot 28.

As discussed above, a drawback with these prior ejectors is that the shooter must manually grasp the cartridge casing after it has been withdrawn from the chamber 20 and pull it form the chamber 20 for discarding.

Figure 4:
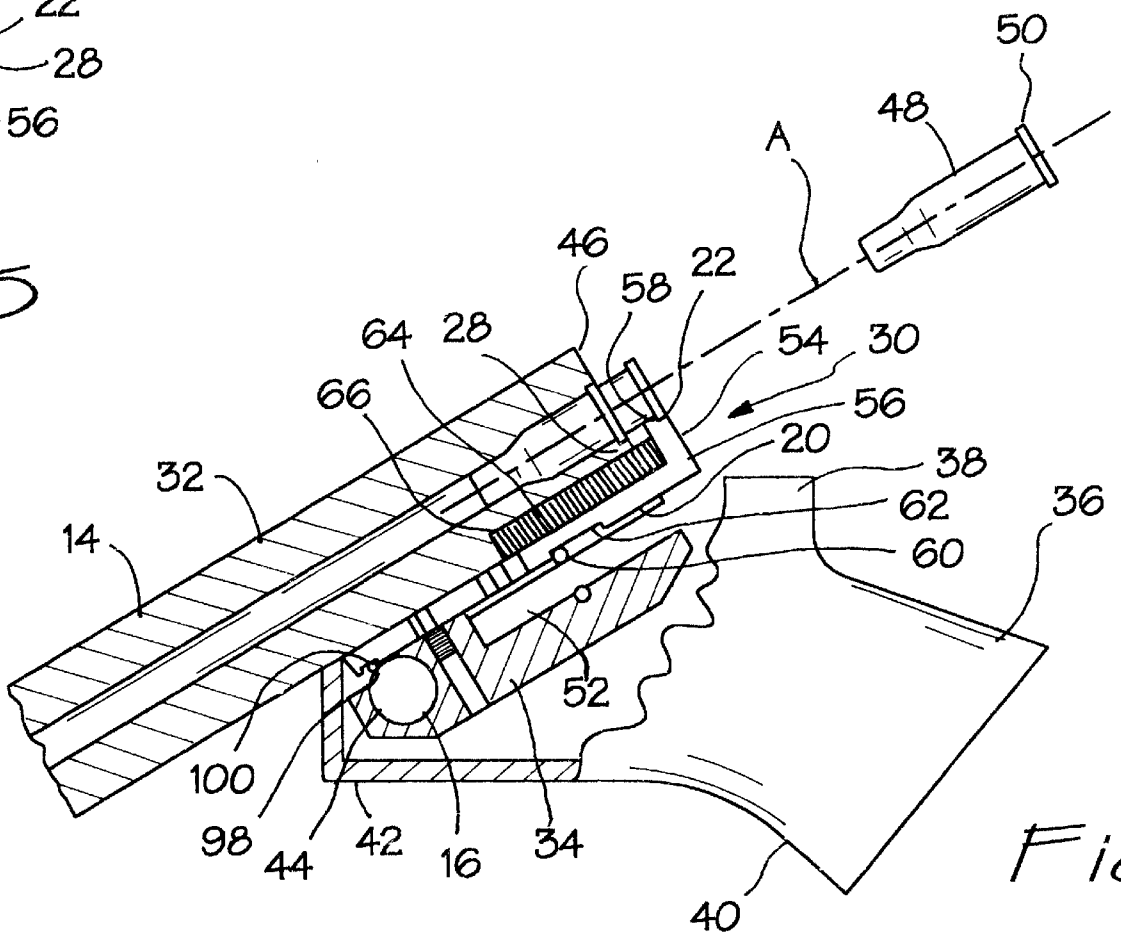
FIG. 4 is a side section of the ejector according to the present invention showing expulsion of a casing.

Turning to FIG. 4, the ejector 30 according to the present invention is shown. The ejector 30 is disposed between a barrel assembly 32 including the barrel 14 and a pivot block assembly 34. As shown in FIG. 4, the barrel 32 and pivot block assembly 34 are pivoted away from a stock assembly 36 which includes a breech assembly 38 having a firing pin mechanism as is known in the art. The stock assembly 36 includes a stock 40 which supports the pivot block assembly 34 and includes a forwardly extending housing 42 containing and mounting the pivot block assembly 34 in a manner known in the art. The housing 42 supports a pivot pin 44 which passes through the bore 16 of the pivot block assembly 34 to support the pivot block assembly 34 for rotation for opening and closing the breech for the firearm.

The barrel 14 has a breech end 46 which, when the barrel assembly 32 is closed to the breech assembly 32 abuts the breech assembly 38 for firing of a cartridge in a manner known in the art. The cartridge has a casing 48 including a circumferential rim 50.

As shown in FIG. 4, the barrel assembly 32 has been pivoted away from the breech assembly 38 for ejection of the casing 48 as hereinafter described.

Figure 5:
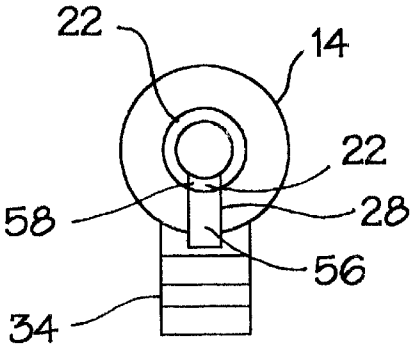
FIG. 5 is an end view of the barrel showing the ejector according to the present invention.

With continuing reference to FIGS. 4 and 5, the pivot block assembly 34 includes a laterally extending groove 52 to mount a component (not shown) for a breech locking mechanism (not shown) as is well known in the art. The breech locking mechanism is adapted to lock the breech closed for firing of the firearm. A release (not shown), also known in the art, is included with the firearm to release the breech locking mechanism for pivoting of the barrel assembly 32 in the manner illustrated in FIG. 4.

The ejector 30 according to the present invention is adapted to be mounted into and through the chamber 20 defined through the pivot block assembly 34 and extending parallel to the axis A for the bore of the barrel 14. The ejector 30 for this purpose includes an ejector slide 54 having a substantially rectangular cross section and including an orthogonal extending finger 56 adapted to engage the rim 50 of the casing 48. Accordingly, the finger 56 has a tip 58 which is circular and includes a countersink 22 to, when the finger 56 is in a seated position in the breech end 46 of the barrel 14 merges with and provides a continuous countersink 22 to closely receive the casing rim 50.

Figure 2:
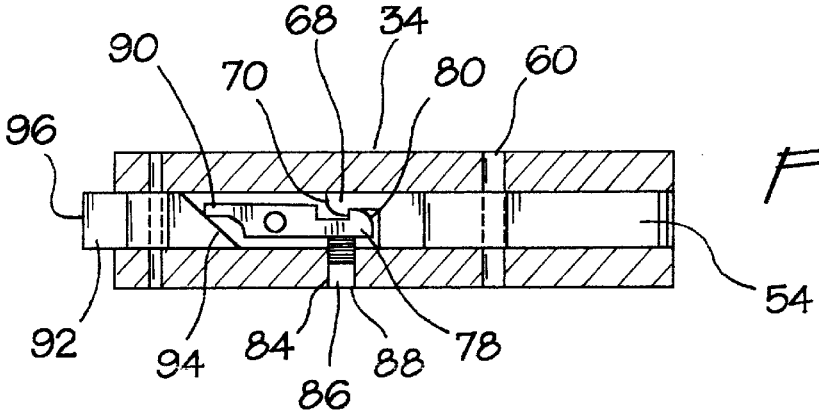
FIG. 2 is a top section view of the pivot block showing the arrangement of ejector according to the present invention with the ejector in a seated position.

To accommodate the finger 56, the breech end 48 has the slot 28. When the slide 54 is in a seated position as shown in FIG. 2, the finger 56 is closely received into the slot 28 and the casing 48 is nested in the countersink 22 and against the tip 58 for firing of the cartridge. When the slide 54 extended to the eject position, as shown in FIGS. 3 and 4, the finger 56 is displaced from the slot 28 to withdraw the casing 48 from the chamber 20.

The slide 54 is retained within the channel 24 by a slide retainer pin 60 which is received through a recess 62 formed at the bottom of the slide 54. The slide retainer pin 60 thus limits the motion of the slide 54 to between the seated and eject positions as shown. The slide retainer pin 60 is mounted through the pivot block assembly 34 as shown in FIGS. 2–4. To urge the slide 54 toward the eject position, an ejector spring 64 is provided and received into a bore 66 extending from the barrel breech end 46 into the barrel assembly 32.

Opposite the finger 56 the slide 54 has a catch 68 including an arcuate forward surface 70 extending to a retention surface 72 the purpose of which will hereinafter become evident.

Figure 3:
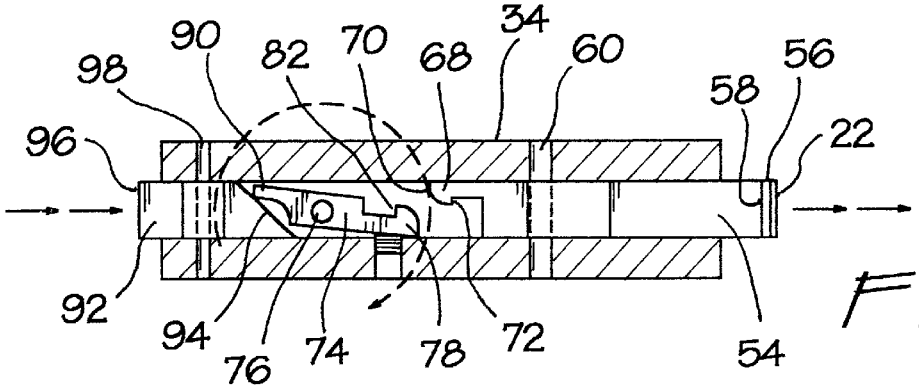
FIG. 3 is top section view similar to that of FIG. 2 showing the extension of the ejector for ejecting a cartridge casing.

With reference to FIGS. 2 and 3, to capture the slide 54 in the seated position, the ejector 30 includes a sear 74 pivotally disposed within the channel 24 for pivotal motion about a sear retention pin 76. The sear 74 has one end at arm 78 includes an arcuate leading edge 80 transitioning to a catch surface 82 adapted to cooperatively Engage the retention surface 72 of the catch 68 to retain the slide 54 in the seated position. To urge the sear 74 to pivot in a counterclockwise direction, the pivot block assembly 34 includes a bore 84 mounting a pin 86 which in turn supports a spring 88 engaging the arm 78 in a lateral direction. Thus, with reference to FIG. 2, the spring 88 urges the to pivot to maintain the engagement between the catch surface 82 and the retention surface 72 of the slide catch 68 thereby retaining the slide 54 against the bias of the ejector spring 64.

Opposite the arm 78, the sear 74 includes a leg 90 adapted to be engaged by a release 92 in the channel 24. As shown in FIGS. 2 and 3, the release 92 includes a slanted engaging surface 94 adapted to engage the leg 90 of the sear 74. Opposite the engaging surface 94, the release 92 has a leading edge 96 adapted to contact the housing 42 for displacement of the release 92 in the manner hereinafter described. To retain and capture the of the release 92, a release pin 98 is received through a recess 100 defined in the underside of the release 92. Thus the release pin 98 and recess 100 cooperate to limit the sliding motion of the release 92 within the channel 24.

With reference to FIG. 4, when the breech of the firearm is open, a cartridge is inserted into the chamber 20 such that the rim 50 of the casing 48 engages the fingertip 58 to be seated there against. The cartridge is urged into the chamber 20 forcing the slide 54 to move into the channel 24 against the bias and compressing the ejector spring 64. The forcing of the slide 54 occurs upon closing of the breech. When the breech is closed the breech assembly 38 is engaged by the extending finger 56 which forces the finger 56 to the seated position. For that purpose a suitable cam surface can be fashioned on the finger 56 or breech assembly 38. The movement of the slide 54 causes the catch forward surface 70 to engage the arm leading edge 80 to pivot the sear 74 against the bias of the spring 88 until the arm 78 clears the forward 70 such that the catch surface 82 snaps into and captures the forward surface 70 of the catch 68 for the slide 54 as shown in FIG. 2. In the position as shown in FIG. 2, the sear leg 90 has engaged the engaging surface 94 of the release 92 to urge it to an extended position as shown in FIG. 2 whereat it extends from the pivot block assembly 34 limited by the release pin 98. In this position, the finger 54 is nested in the slot 28 and the breech end 18 for the barrel 14 is closed against the breech assembly 38 for firing of the weapon. When closed, the breech locking assembly (not shown) locks the barrel assembly 32 and pivot block assembly 34 in the firing position with the breech end 18 nested against the breech of the stock assembly 36.

After the cartridge has been fired, the breech lock is released to permit the barrel assembly 32 to be pivoted relative to the stock assembly 36 as suggested in FIG. 4. After the breech end 18 has cleared the breech assembly 38, the leading edge 96 of the release 92 engages the housing 42 which urges the release 92 to the right, as suggested in FIG. 3, whereupon its engaging surface 94 urges the leg 90 of the sear 74 to pivot the sear 74 in a clockwise direction. As the sear 74 is pivoted, the catch surface 82 clears the forward surface 70 of the catch 68 for the slide 54 freeing the slide 54 to be forcibly urged to the right in FIG. 3 by the ejector spring 64 to expel the casing 48 from the chamber 20 as the slide 54 snaps to the eject position. The snapping action of the slide 54 imparts sufficient momentum to the casing 48 to expel it from the chamber.

Thus, the shooter need not remove the casing 48 in that the ejector 30 according to the present invention ejects the casing 48 and throws it from the firearm.

A further advantage of the ejector 30 of the present invention is that it may be mounted in a firearm which previously included an ejector 10 according to the prior art. The slide 54, sear 74 and release 92 are designed and adapted to fit within the channel 24 thus providing the advantages of a retrofit ejector 30 without requiring a great deal of modifications to the barrel assembly 32 or pivot block assembly 34.

While I have shown and described certain embodiments of the invention, it is to be understood that is subject to many modifications

We claim:

1. A retrofit snap cartridge ejector for replacing a manual cartridge extraction means of a firearm of the type having a breech assembly and a barrel assembly including a barrel having a receiver end to receive a cartridge and abut the breech assembly when the breech is closed, said barrel assembly adapted to pivot from the breech assembly to open the breech, said cartridge including a rim, the ejector comprising:

a pivot block disposed on the barrel assembly to support the barrel during opening and closing of the breech;

said pivot block including a channel therethrough to accommodate said ejector;

a stock assembly to support the barrel and the pivot block to support the barrel assembly;

an ejector slide supported by the pivot block throughout a sliding motion from a seated position to an eject position, said slide including a finger configured to engage the cartridge rim when the cartridge is seated at the breech end and the slide is at the seated position and a catch, a spring disposed between the slide and the pivot block to urge the slide from the seated position to the eject position to extend outwardly from the receiver end, a retainer pivotally disposed at the pivot block and including an arm to engage the catch to hold the slide at the seated position against the bias of the spring and a release moveably disposed in the pivot block to engage and pivot the retainer in response to opening of the breech to disengage the arm from the catch to release the slide to snap to the eject position to eject the cartridge from the breech.

2. The ejector of claim 1 including said release disposed to engage the stock assembly when the barrel assembly is pivoted to open the breech.

3. The ejector of claim 1 wherein said barrel receiver end includes a countersink to closely receive the cartridge rim when the cartridge is loaded in the barrel and said receiver includes a radial slot to receive the finger.

4. The ejector of claim 3 wherein said finger is arcuate to conform to the cartridge rim.

* * * * *